US008275148B2

(12) United States Patent
Li et al.

(10) Patent No.: US 8,275,148 B2
(45) Date of Patent: Sep. 25, 2012

(54) AUDIO PROCESSING APPARATUS AND METHOD

(75) Inventors: Xi-Lin Li, Cupertino, CA (US); Sheng Liu, Cupertino, CA (US)

(73) Assignee: Fortemedia, Inc., Sunnyvale, CA (US)

( * ) Notice: Subject to any disclaimer, the term of this patent is extended or adjusted under 35 U.S.C. 154(b) by 551 days.

(21) Appl. No.: 12/510,449

(22) Filed: Jul. 28, 2009

(65) Prior Publication Data

US 2011/0026730 A1 Feb. 3, 2011

(51) Int. Cl.
*H04R 3/00* (2006.01)

(52) U.S. Cl. ..... 381/92; 381/93; 704/233

(58) Field of Classification Search ..... 381/91–94.9, 381/98, 66, 83; 702/189, 190, 194, 196; 704/233, 226
See application file for complete search history.

(56) References Cited

U.S. PATENT DOCUMENTS

2007/0088544 A1* 4/2007 Acero et al. ..... 704/226
2008/0215651 A1* 9/2008 Sawada et al. ..... 708/205
2009/0228272 A1* 9/2009 Herbig et al. ..... 704/233
2009/0299742 A1* 12/2009 Toman et al. ..... 704/233

* cited by examiner

*Primary Examiner* — Fan Tsang
*Assistant Examiner* — Eugene Zhao
(74) *Attorney, Agent, or Firm* — Thomas|Kayden

(57) ABSTRACT

An audio processing apparatus is provided, comprising: a main microphone for receiving sounds from a source and noises from non-source sources and generating a main input; a reference microphone for receiving the sounds and the noises and generating a reference input; a short-time Fourier transformation (STFT) unit for applying short time Fourier transformation to convert the main input of a time domain signals into a main signal of a frequency domain and convert the reference input of the time domain signals into a reference signal of the frequency domain; a sensitivity calibrating unit for performing sensitivity calibration on the main signal and the reference signal and generating a main calibrated signal and a reference calibrated signal; and a voice active detector (VAD) for generating a voice active signal according to the main calibrated signal, the reference calibrated signal and a direction of arrival (DOA) signal.

26 Claims, 7 Drawing Sheets

AUDIO PROCESSING APPARATUS AND METHOD

BACKGROUND OF THE INVENTION

1. Field of the Invention

The present invention relates to an audio processing apparatus and method, and in particular relates to an audio processing apparatus and method for microphone sensitivity calibration.

2. Description of the Related Art

There are numerous methods for a microphone array to process audio signals. For example, generalized sidelobe cancellation (GSC) is a popular method.

FIG. 1 shows a schematic diagram of a conventional audio processing apparatus using the GSC method. The audio processing apparatus 100 comprises a main microphone 110, a reference microphone 120, a fixed beamformer 130, an adaptive blocking filter 140 and an adaptive interference canceller 150. The main microphone 110 and the reference microphone 120 receive sounds from an audio source (not shown in FIG. 1) and, inevitably, noises from non-audio source sources, wherein the sounds are desired signals but the noises are not. The input signals generated by the main microphone 110 and the reference microphone 120 are further provided to the fixed beamformer 130 and to the adaptive blocking filter 140. The fixed beamformer 130 uses the GSC method, to extract the desired signals from the mixture of the sounds and the noises and generate a main channel output corresponding to the sounds, and the adaptive blocking filter 140 removes the desired signals from the mixture of the sounds and the noises and generates a reference channel output corresponding to the noises. Since there are always sidelobes in the main channel output due to leakages from the reference channel at different frequencies, the adaptive interference canceller 150 is coupled to the fixed beamformer 130 and the adaptive blocking filter 140 to compensate the main channel output and obtain the final output. After beamforming, the final output is provided to and processed by a Wiener post-filter to further reduce the stationary and non-stationary noises.

Performance of the GSC beamforming or for the following Wiener post-filtering depends on the perfect matching of the sensitivity of the two microphones 110 and reference microphone 120. The voice activity detectors (VADs) are implemented both in the adaptive blocking filter 140 and adaptive interference canceller 150 to avoid the cancellation the desired sound. Without reliable microphone sensitivity calibration, it is impossible for the VADs to provide correct information. However, sensitivity mismatch between microphones always occur. Moreover, since the GSC beamforming is implemented in the time domain and the sounds and the noises are mixed when they are received, it is hard for the GSC beamforming to remove all of the instantaneous interference. Thus, a new method to deal with the problematic issues described previously is needed.

BRIEF SUMMARY OF INVENTION

An audio processing apparatus is provided, comprising: a main microphone for receiving sounds from a source and noises from non-source sources and generating a main input; a reference microphone for receiving the sounds and the noises and generating a reference input; a short-time Fourier transformation (STFT) unit for applying short time Fourier transformation to convert the main input of a time domain signals into a main signal of a frequency domain and convert the reference input of the time domain signals into a reference signal of the frequency domain; a sensitivity calibrating unit for performing sensitivity calibration on the main signal and the reference signal and generating a main calibrated signal and a reference calibrated signal; a voice active detector (VAD) for generating a voice active signal according to the main calibrated signal, the reference calibrated signal and a direction of arrival (DOA) signal; and a beamformer for converting the main calibrated signal into a main channel and converting the reference calibrated signal into a reference channel according to the voice active signal.

An audio processing method is provided, comprising: receiving sounds from a source and noises from non-source sources and generating a main input; receiving the sounds and the noises and generating a reference input; applying short time Fourier transformation to convert the main input of a time domain signals into a main signal of a frequency domain and convert the reference input of the time domain signals into a reference signal of the frequency domain; performing sensitivity calibration on the main signal and the reference signal and generating a main calibrated signal and a reference calibrated signal; generating a voice active signal according to the main calibrated signal, the reference calibrated signal and a direction of arrival (DOA) signal; and converting the main calibrated signal into a main channel and converting the reference calibrated signal into a reference channel according to the voice active signal.

A detailed description is given in the following embodiments with reference to the accompanying drawings.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
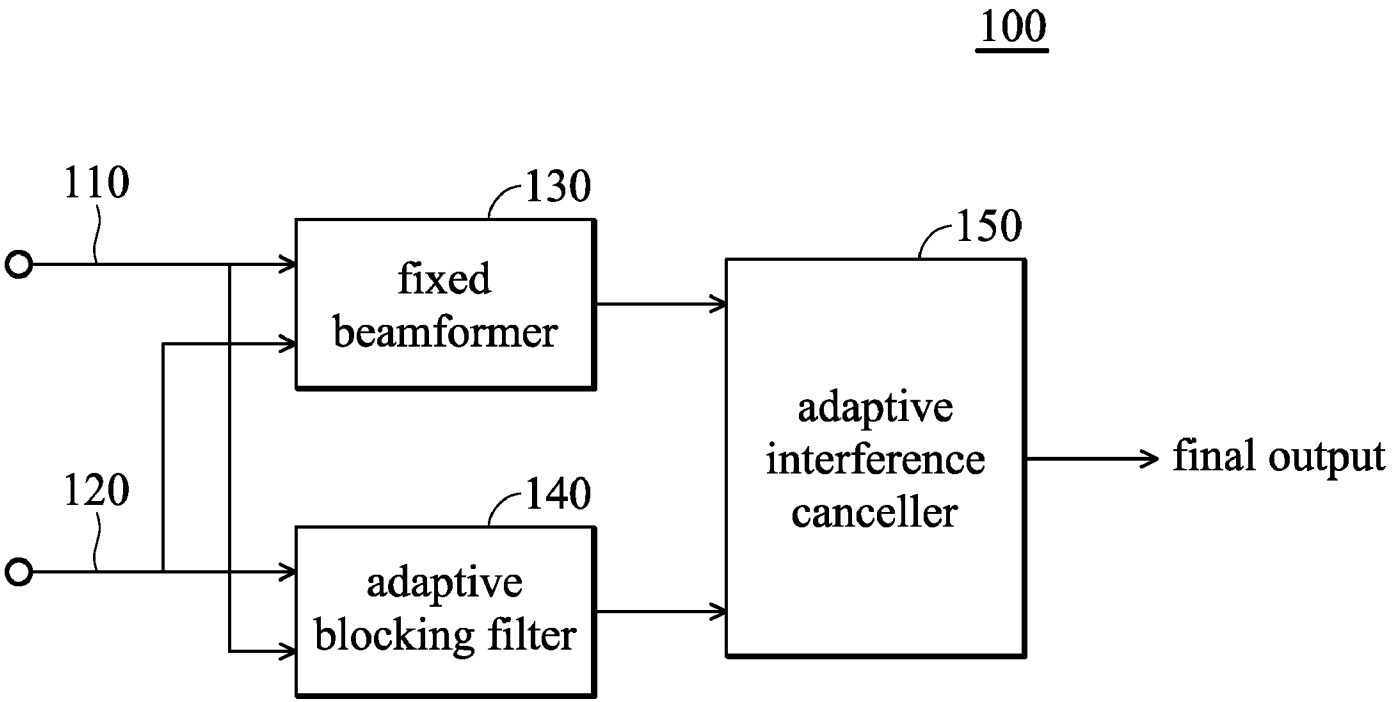
FIG. 1 ( PRIOR ART )
FIG. 1 shows a schematic diagram of a conventional audio processing apparatus using the GSC method.
Figure 2A:
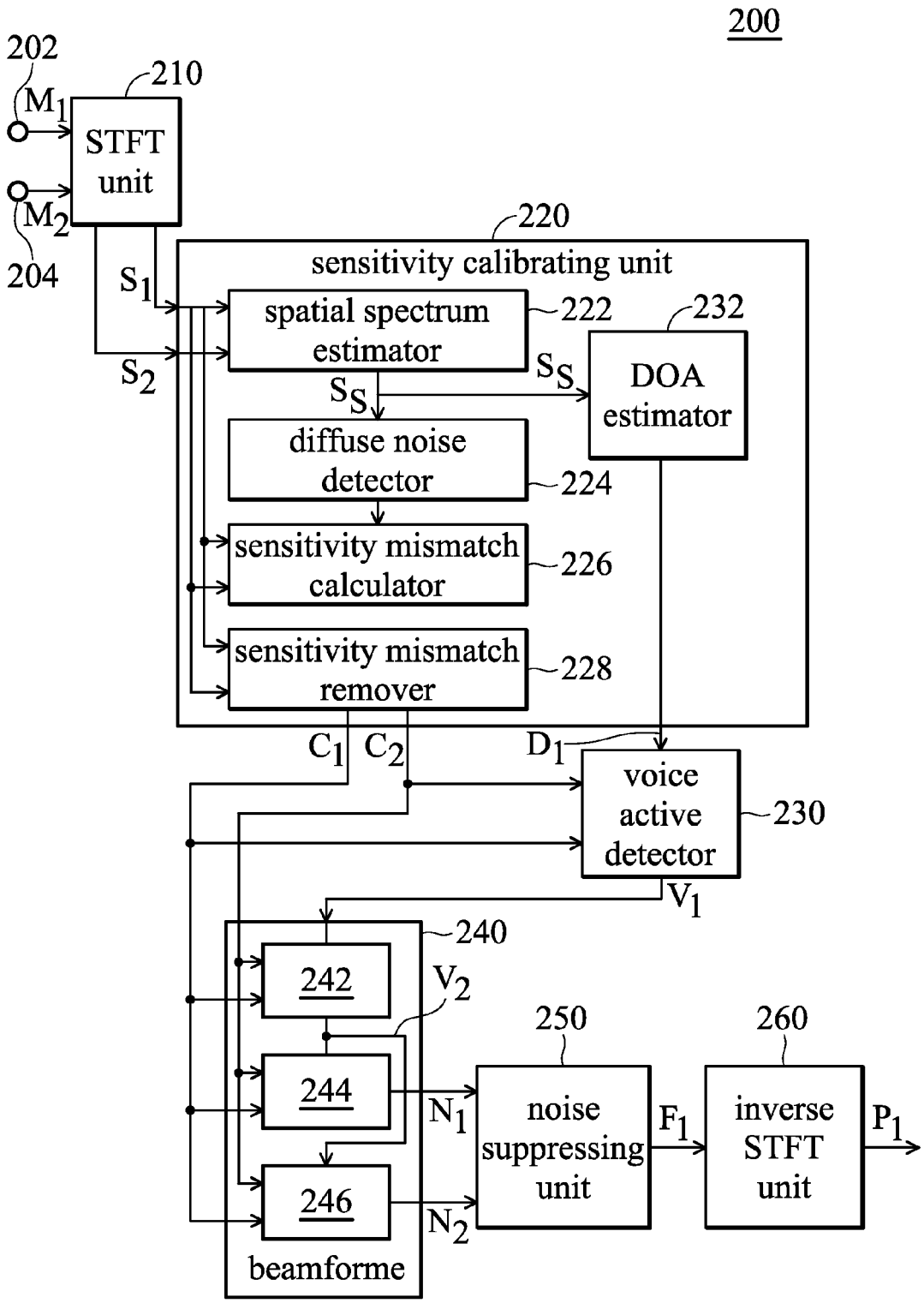
FIG. 2A shows an audio processing apparatus according to an embodiment of the present invention.

FIG. 2A shows an audio processing apparatus according to an embodiment of the present invention. The audio processing apparatus 200 comprises a main microphone 202, a reference microphone 204, a short-time Fourier transformation (STFT) unit 210, a sensitivity calibrating unit 220, a voice active detector (VAD) 230, a beamformer 240, a noise suppressing unit 250 and an inverse STFT unit 260.

Figure 2B:
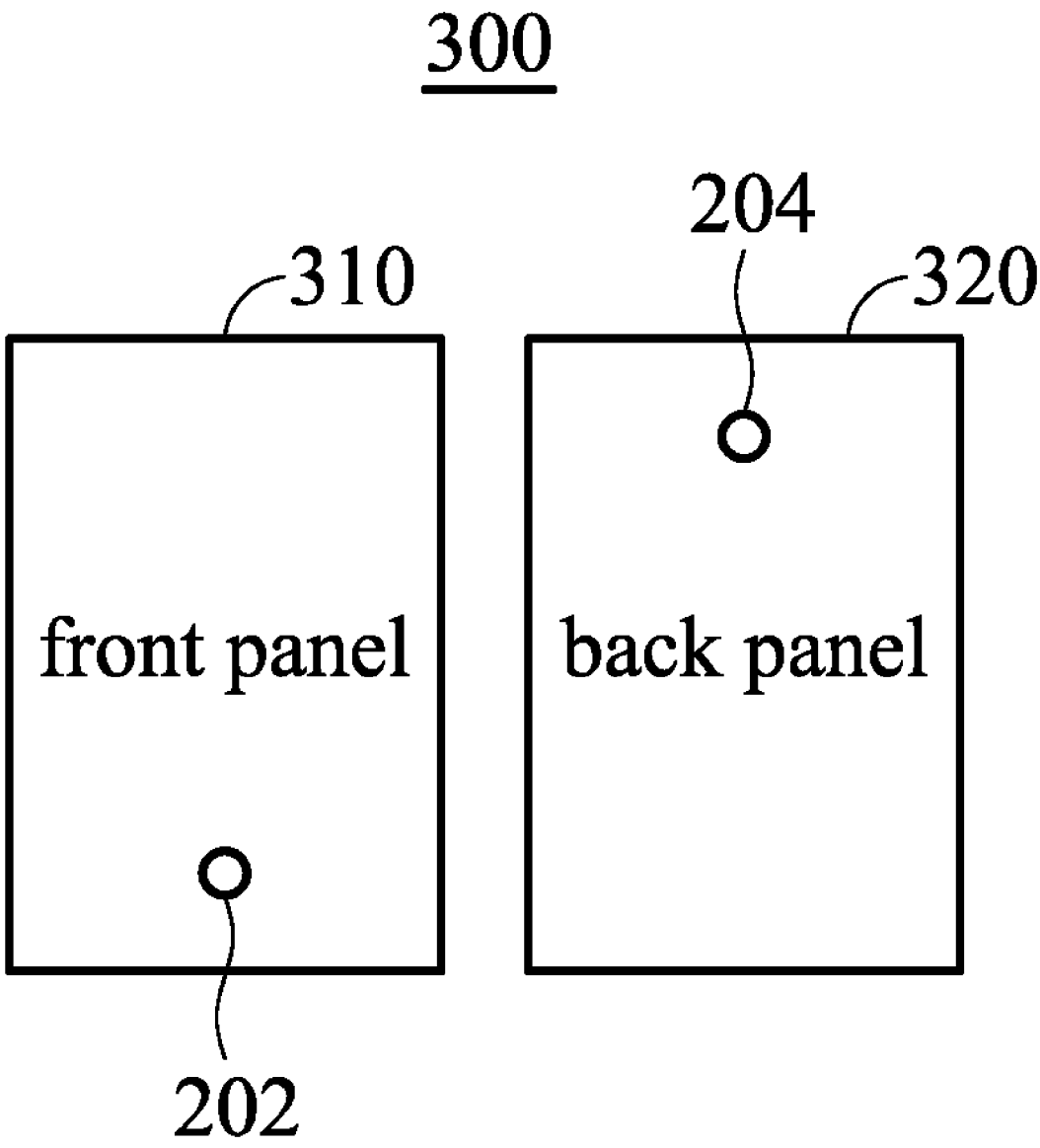
FIG. 2B shows an example of the placement of the main and reference microphones on a cell phone.

For convenience, the audio processing apparatus 200 in the invention is described as a cell phone in this embodiment, however, those skilled in the art will appreciate that the invention is not limited thereto. The main microphone 202 and the reference microphone 204 are all used to receive sounds from a source (not shown in FIG. 2) and noises from non-source sources, and the main microphone 202 and the reference microphone 204 are disposed on different locations of the cell phone. FIG. 2B shows an example of the placement of the main and reference microphones on a cell phone. In this example, the cell phone 300 comprises a front panel 310 and a back panel 320 and the main microphone 202 is disposed on the bottom of the front panel 310, and the reference microphone 204 is disposed on the top of the back panel 320 (the present invention is not limited thereto). The main microphone 202 is closer to the source, e.g. a speaker's mouth, than the reference microphone 204. Note that there is also a physical barrier between the front side 310 and the back side 320 so the reference microphone 204 may capture less sound from the source than the main microphones 202. The placement of the two microphones is advantageous for signal processing. In this embodiment, the main microphone 202 and the reference microphone 204 will respectively convert the mixture of the sounds and the noises t into a main input M1 and a reference input M2 as shown in FIG. 2.

The main input M1 and the reference input M2 are time domain signals provided to the STFT unit 210. The STFT unit 210 respectively converts the main input M1 and the reference input M2 of the time domain signals into a main signal S1 and a reference signal S2 of the frequency domain.

The sensitivity calibrating unit 220 receives the main signal S1 and the reference signal S2 and performs the sensitivity calibration on the main signal S1 and reference signal S2 to generate a main calibrated signal C1 and a reference calibrated signal C2. The sensitivity calibrating unit 220 in the present invention further comprises a spatial spectrum estimator 222, a diffuse noise detector 224, a sensitivity mismatch calculator 226 and a sensitivity mismatch remover 228 to eliminate sensitivity mismatch so that the audio processing apparatus 200 may obtain better signals.

The spatial spectrum estimator 222 is used to generate a spatial spectrum SS according to the main signal S1 and the reference signal S2. There are numerous methods in which the spatial spectrum estimator 222 may obtain the spatial spectrum SS, which include, Capon spatial spectrum SS estimation, multiple signal classification (MUSIC) spatial spectrum SS estimation, GCC spatial spectrum SS estimation and phase transfer (PHAT) spatial spectrum SS estimation. In this embodiment, the spatial spectrum SS depicts the functional relationship between the power distribution and the angles of incident of the main signal and reference signals. The mixture of the sounds and noises received by the main microphone 202 and the reference microphone 204 are shown in the spatial spectrum SS. As is well known in the art, a substantially flat curve in the spatial spectrum SS is caused by far field noises, and sharp and dominant peaks in the spatial spectrum SS is caused by near field sounds of a speaker's voice and spot noises from the environment.

The present invention uses the diffuse noises to calibrate the sensitivity mismatch between the microphones 202 and 204. The diffuse noise detector 224 is used to inspect the spatial spectrum SS to indicate whether the diffuse noises exist or not. Generally, the diffuse noises will cause flat curves in the spatial spectrum SS, and those skilled in the art can easily distinguish the diffuse noises from the spot noises. Since the diffuse noises are regarded as far field noises, it is assumed that the power sensed by the main microphone 202 and the reference microphone 204 is the same. The sensitivity mismatch calculator 226 is disposed in the present invention to determine a sensitivity mismatch between the main signal S1 and reference signal S2 when the diffuse noise detector 224 indicates that the diffuse noises exist. Following, the sensitivity mismatch remover 228 receives the main signal S1 and the reference signal S2 and removes the sensitivity mismatch between the main signal S1 and the reference signal S2 to generate the main calibrated signal C1 and the reference calibrated signal C2.

Following, the sensitivities of the microphone 202 and 204 are calibrated to be the same, and the main calibrated signal C1 and the reference calibrated signal C2 may be further processed to obtain better signals. The audio processing apparatus 200 further comprises a direction of arrival (DOA) estimator 232 for inspecting the spatial spectrum SS and generating a DOA signal D1, wherein the DOA signal D1 indicates whether there is a dominant peak in the spatial spectrum SS. The VAD 230 is used to generate a voice active signal V1 according to the main calibrated signal C1, reference calibrated signal C2 and the DOA signal D1. Specifically, the VAD 230 compares a power ratio between the main calibrated signal C1 and the reference calibrated signal C2 with a predetermined threshold bin by bin. For example, when the power ratio in one bin is smaller than the pre-defined threshold, the signals in that bin may be regarded as noises and may be eliminated, and the voice active signal will be turned on. However, when the power ratio in one bin is larger than the pre-defined threshold, the signals in that bin may be regarded as desired signals and may be preserved, and the voice active signal will be turned off.

The beamformer 240 is used to convert the main calibrated signal C1 into a main channel N1 and convert the reference calibrated signal C2 into a reference channel N2 according to the voice active signal V1. The beamformer 240 further comprises an array manifold matrix identification unit 242, a main channel generator 244 and a reference channel generator 246. The array manifold matrix identification unit 242 is used to track the signal subspace and generate a steering vector signal V2 according to the voice active signal V1. A signal subspace tracking method, e.g. the PAST algorithm, may be implemented in the array manifold matrix identification unit 242, and the steering vector signal V2 indicates directional vector at each frequency bin according to the voice active signal V1 which is provided by the VAD 230. The main channel generator 244 is used to receive the main calibrated signal C1 and the reference calibrated signal C2 and generate the main channel N1 according to the steering vector signal V2, wherein the main channel N1 is corresponding to the sounds received from the source. For example, the minimal variance distortion response (MVDR) algorithm may be implemented in the main channel generator 244 to accomplish the beamforming process. The reference channel generator 246 is used to receive the main calibrated signal C1 and the reference calibrated signal C2 and generate the reference channel N2 according to the steering vector signal V2, wherein the reference channel N2 is corresponding to the noises received from non-source sources. For example, the reference channel generator 246 may null the desired signals (the sounds from the source) in order to obtain the reference channel N2.

Although the main channel N1 and the reference channel N2 are obtained after the process of the beamformer 240, some nonlinear noises still remain. The noise suppressing unit 250 is used to further suppress stationary and non-stationary noises in the main channel N1 and the reference channel N2 according to the voice active signal V1, and integrate the main channel N1 and the reference channel N2 into a final signal F1. For example, the noise suppressing unit is a Wiener post filter. Following, the inverse STFT unit 260 is used to apply inverse short time Fourier transformation to convert the final signal F1 of the frequency domain signals into a final output P1 of the time domain.

Figure 3A:
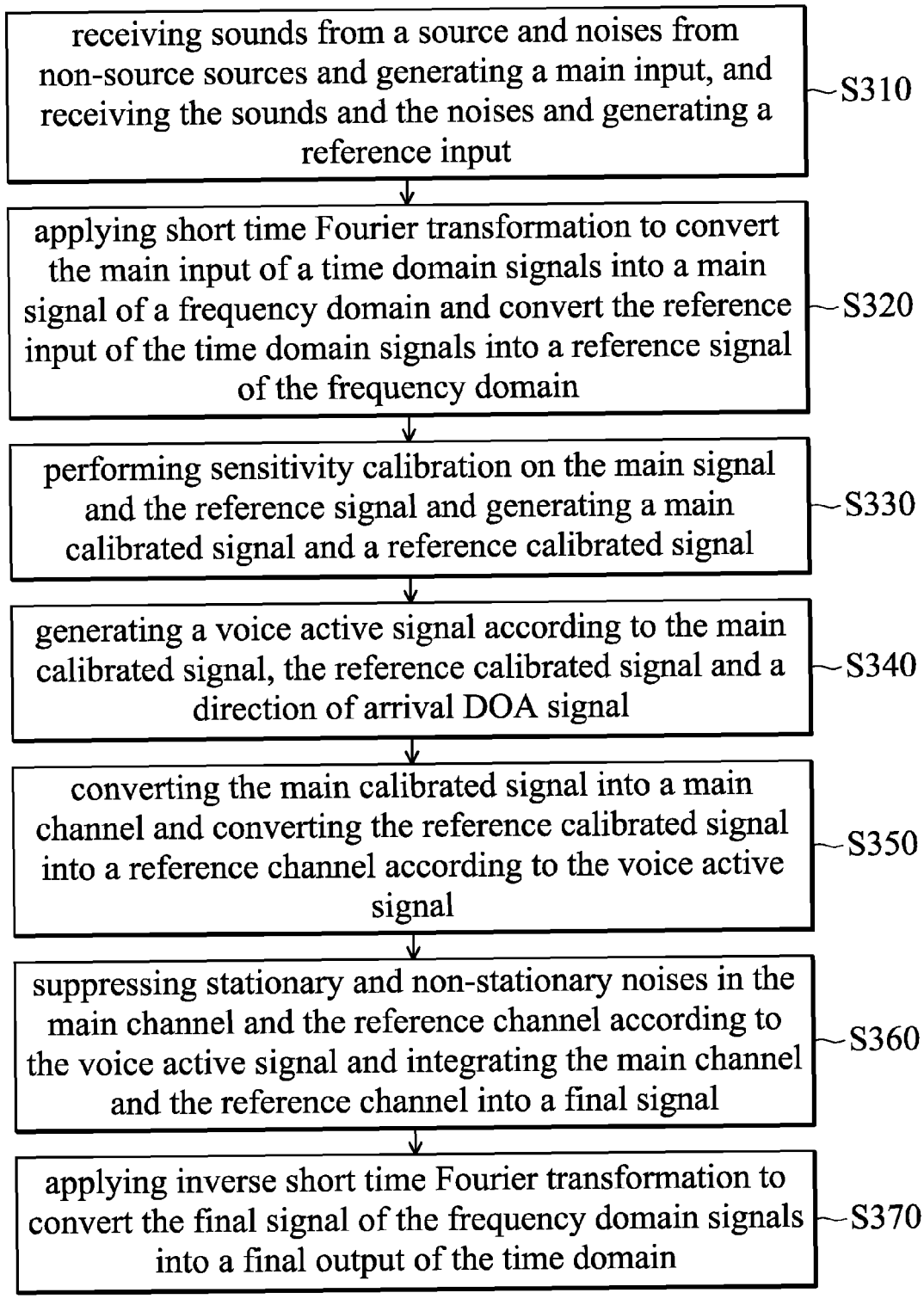
FIG. 3A shows the flow chart of an audio processing method according to an embodiment of the present invention.

The present invention further provides an audio processing method. FIG. 3A shows the flow chart of an audio processing method according to an embodiment of the present invention. Please refer to FIG. 3A and FIG. 2A, the audio processing method comprises: in step S310, receiving sounds from a source and noises from non-source sources and generating a main input M1, and receiving the sounds and the noises and generating a reference input M2; in step S320, applying short time Fourier transformation to convert the main input M1 of a time domain signals into a main signal S1 of a frequency domain and convert the reference input M2 of the time domain signals into a reference signal S2 of the frequency domain; in step S330, performing sensitivity calibration on the main signal S1 and the reference signal S2 and generating a main calibrated signal C1 and a reference calibrated signal C2; in step S340, generating a voice active signal V1 according to the main calibrated signal C1, the reference calibrated signal C2 and a direction of arrival DOA signal D1; in step S350, converting the main calibrated signal C1 into a main channel N1 and converting the reference calibrated signal C2 into a reference channel N2 according to the voice active signal V2; in step S360, suppressing stationary and non-stationary noises in the main channel N1 and the reference channel N2 according to the voice active signal V1 and integrating the main channel N1 and the reference channel N2 into a final signal F1; and in step S370, applying inverse short time Fourier transformation to convert the final signal F1 of the frequency domain signals into a final output P1 of the time domain.

Figure 3B:
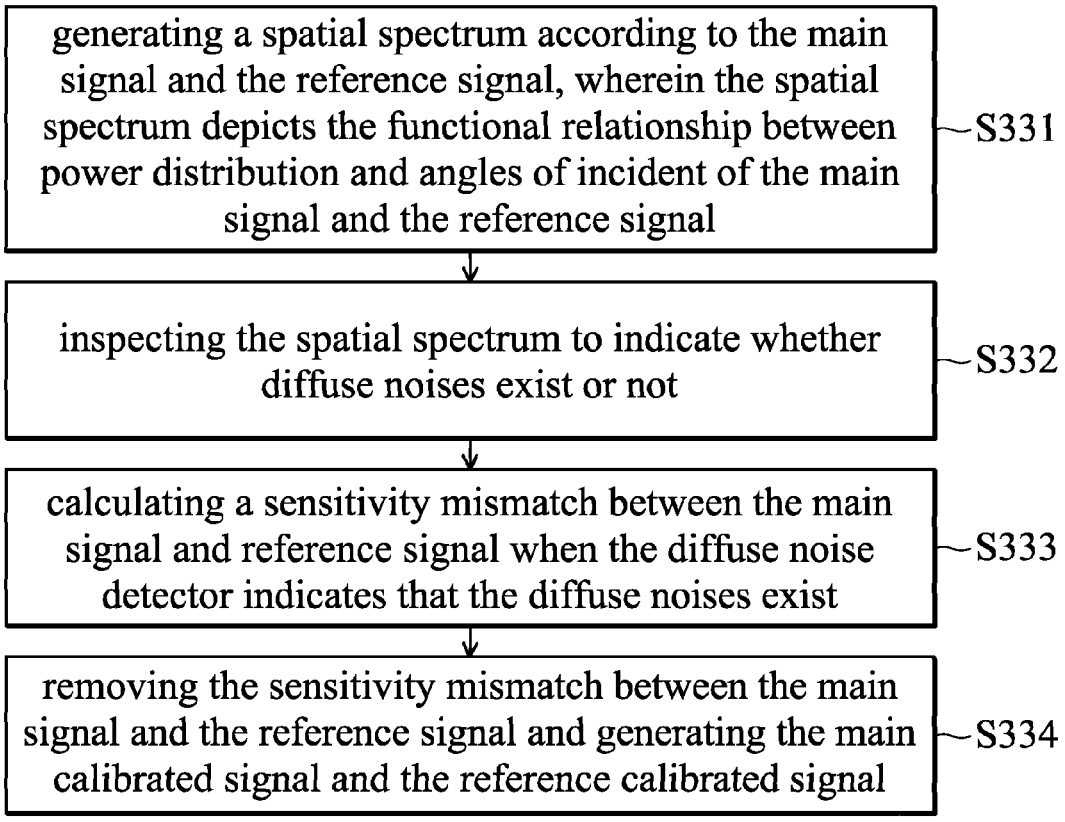
FIG. 3B shows the detailed flow chart of step S330.

FIG. 3B shows the detailed flow chart of step S330. Please refer to FIG. 3B and FIG. 2. The step S330 further comprises: in step S331, generating a spatial spectrum SS according to the main signal S1 and the reference signal S2, wherein the spatial spectrum SS depicts the functional relationship between power distribution and angles of incident of the main signal S1 and the reference signal S2; in step S332, inspecting the spatial spectrum SS to indicate whether diffuse noises exist or not; in step S333, calculating a sensitivity mismatch between the main signal S1 and reference signal S2 when the diffuse noise detector indicates that the diffuse noises exist; and in step S334, removing the sensitivity mismatch between the main signal S1 and the reference signal S2 and generating the main calibrated signal C1 and the reference calibrated signal C2.

Figure 3C:
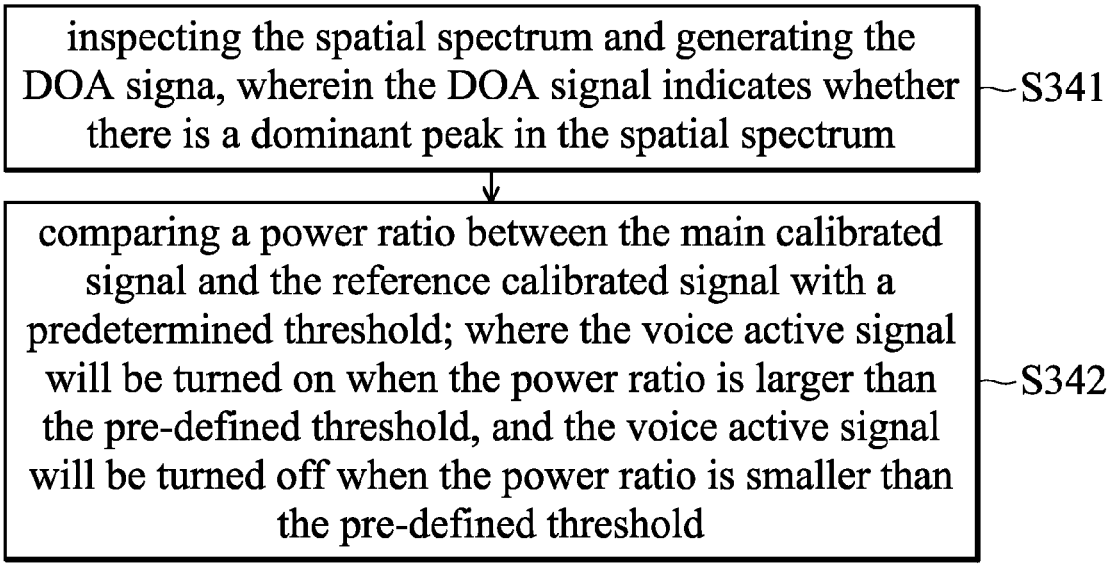
FIG. 3C shows the detailed flow chart of step S340.

FIG. 3C shows the detailed flow chart of step S340. Please refer to FIG. 3C and FIG. 2. The step S340 further comprises: in step S341, inspecting the spatial spectrum SS and generating the DOA signal D1, wherein the DOA signal D1 indicates whether there is a dominant peak in the spatial spectrum SS; and in step S342, comparing a power ratio between the main calibrated signal C1 and the reference calibrated signal C2 with a predetermined threshold; where the voice active signal V1 will be turned on when the power ratio is larger than the pre-defined threshold, and the voice active signal V2 will be turned off when the power ratio is smaller than the pre-defined threshold.

Figure 3D:
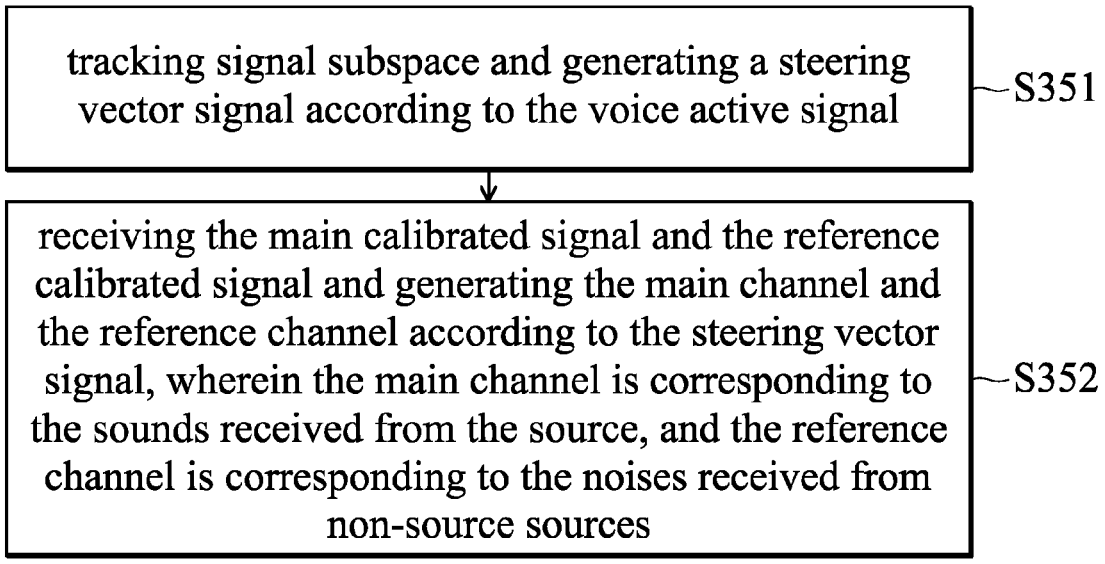
FIG. 3D shows the detailed flow chart of step S350.

FIG. 3D shows the detailed flow chart of step S350. Please refer to FIG. 3D and FIG. 2. The step S350 further comprises: in step S351, tracking signal subspace and generating a steering vector signal V2 according to the voice active signal V1; and in step S352, receiving the main calibrated signal C1 and the reference calibrated signal C2 and generating the main channel N1 and the reference channel N2 according to the steering vector signal V2, wherein the main channel N1 is corresponding to the sounds received from the source, and the reference channel N2 is corresponding to the noises received from non-source sources.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An audio processing apparatus, comprising:

a main microphone for receiving sounds from a source and noises from non-source sources and generating a main input;

a reference microphone for receiving the sounds and the noises and generating a reference input;

a short-time Fourier transformation (STFT) unit for applying short time Fourier transformation to convert the main input of a time domain signals into a main signal of a frequency domain and convert the reference input of the time domain signals into a reference signal of the frequency domain;

a sensitivity calibrating unit for performing sensitivity calibration on the main signal and the reference signal and generating a main calibrated signal and a reference calibrated signal;

a voice active detector (VAD) for generating a voice active signal according to the main calibrated signal, the reference calibrated signal and a direction of arrival (DOA) signal; and a beamformer for converting the main calibrated signal into a main channel and converting the reference calibrated signal into a reference channel according to the voice active signal.

2. The audio processing apparatus as claimed in claim 1, wherein the main microphone is disposed closer to the source than the reference microphone.

3. The audio processing apparatus as claimed in claim 1, wherein the sensitivity calibrating unit further comprises a spatial spectrum estimator for generating a spatial spectrum according to the main signal and the reference signal, wherein the spatial spectrum depicts a functional relationship between power distribution and angles of incident of the main signal and the reference signal, where a substantially flat curve in the spatial spectrum is caused by far field noises, and sharp and dominant peaks in the spatial spectrum is caused by near field sounds of a speaker's voice and spot noises from the environment.

4. The audio processing apparatus as claimed in claim 3, wherein the sensitivity calibrating unit further comprises a diffuse noise detector for inspecting the spatial spectrum to indicate whether diffuse noises exist or not.

5. The audio processing apparatus as claimed in claim 4, wherein the sensitivity calibrating unit further comprises a sensitivity mismatch calculator for calculating a sensitivity mismatch between the main signal and the reference signal when the diffuse noise detector indicates that the diffuse noises exist.

6. The audio processing apparatus as claimed in claim 5, wherein the sensitivity calibrating unit further comprises a sensitivity mismatch remover used for receiving the main signal and the reference signal, removing the sensitivity mismatch between the main signal and the reference signal and generating the main calibrated signal and the reference calibrated signal.

7. The audio processing apparatus as claimed in claim 3, further comprising, a DOA estimator for inspecting the spatial spectrum and generating the DOA signal D1, wherein the DOA signal D1 indicates whether there is a dominant peak in the spatial spectrum.

8. The audio processing apparatus as claimed in claim 1, wherein the VAD compares a power ratio between the main calibrated signal and the reference calibrated signal with a predetermined threshold; where the voice active signal will be turned on when the power ratio is larger than the pre-defined threshold, and the voice active signal will be turned off when the power ratio is smaller than the pre-defined threshold.

9. The audio processing apparatus as claimed in claim 1, wherein the beamformer further comprises an array manifold matrix identification unit for tracking signal subspace and generating a steering vector signal according to the voice active signal.

10. The audio processing apparatus as claimed in claim 9, wherein the beamformer further comprises:

a main channel generator for receiving the main calibrated signal and the reference calibrated signal and generating the main channel according to the steering vector signal, wherein the main channel is corresponding to the sounds received from the source; and a reference channel generator for receiving the main calibrated signal and the reference calibrated signal and generating the reference channel according to the steering vector signal, wherein the reference channel is corresponding to the noises received from non-source sources.

11. The audio processing apparatus as claimed in claim 1, further comprising, a noise suppressing unit used for suppressing stationary and non-stationary noises in the main channel and the reference channel according to the voice active signal and integrating the main channel and the reference channel into a final signal.

12. The audio processing apparatus as claimed in claim 11, further comprising, an inverse STFT unit for applying inverse short time Fourier transformation to convert the final signal of the frequency domain signals into a final output of the time domain.

13. The audio processing apparatus as claimed in claim 9, wherein the array manifold matrix identification unit uses a projection approximation subspace tracking (PAST) algorithm.

14. The audio processing apparatus as claimed in claim 10, wherein the main channel generator and the reference channel generator use a minimal variance distortionless response (MVDR) beamforming method to generate the main channel and the reference channel.

15. The audio processing apparatus as claimed in claim 11, wherein the noise suppressing unit is a Wiener post filter.

16. An audio processing method, comprising:

receiving sounds from a source and noises from non-source sources and generating a main input;

receiving the sounds and the noises and generating a reference input;

applying short time Fourier transformation to convert the main input of a time domain signals into a main signal of a frequency domain and convert the reference input of the time domain signals into a reference signal of the frequency domain;

performing sensitivity calibration on the main signal and the reference signal and generating a main calibrated signal and a reference calibrated signal;

generating a voice active signal according to the main calibrated signal, the reference calibrated signal and a direction of arrival (DOA) signal; and converting the main calibrated signal into a main channel and converting the reference calibrated signal into a reference channel according to the voice active signal.

17. The audio processing method as claimed in claim 16, further comprising, generating a spatial spectrum according to the main signal and the reference signal, wherein the spatial spectrum depicts a functional relationship between power distribution and angles of incident of the main signal and the reference signal, where a substantially flat curve in the spatial spectrum is caused by far field noises, and sharp and dominant peaks in the spatial spectrum is caused by near field sounds of a speaker's voice and spot noises from the environment.

18. The audio processing method as claimed in claim 17, further comprising, inspecting the spatial spectrum to indicate whether diffuse noises exist or not.

19. The audio processing method as claimed in claim 18, further comprising, calculating a sensitivity mismatch between the main signal and reference signal when the diffuse noise detector indicates that the diffuse noises exist.

20. The audio processing method as claimed in claim 19, further comprising, removing a sensitivity mismatch between a main signal and a reference signal and generating a main calibrated signal and the reference calibrated signal.

21. The audio processing method as claimed in claim 17, further comprising, inspecting the spatial spectrum and generating the DOA signal D1, wherein the DOA signal D1 indicates whether there is a dominant peak in the spatial spectrum.

22. The audio processing method as claimed in claim 21, further comprising, comparing power ratio between the main calibrated signal and the reference calibrated signal with a predetermined threshold; where the voice active signal will be turned on when the power ratio is larger than the pre-defined threshold, and the voice active signal will be turned off when the power ratio is smaller than the pre-defined threshold.

23. The audio processing method as claimed in claim 16, further comprising, tracking signal subspace and generating a steering vector signal according to the voice active signal.

24. The audio processing method as claimed in claim 23, further comprising, receiving the main calibrated signal and the reference calibrated signal and generating the main channel and the reference channel according to the steering vector signal, wherein the main channel is corresponding to the sounds received from the source, and the reference channel is corresponding to the noises received from non-source sources.

25. The audio processing method as claimed in claim 16, further comprising, suppressing stationary and non-stationary noises in the main channel and the reference channel according to the voice active signal and integrating the main channel and the reference channel into a final signal.

26. The audio processing method as claimed in claim 25, further comprising, applying inverse short time Fourier transformation to convert the final signal of the frequency domain signals into a final output of the time domain.

* * * * *